US008409375B2

(12) United States Patent
Yoshida et al.

(10) Patent No.: US 8,409,375 B2
(45) Date of Patent: Apr. 2, 2013

(54) METHOD OF PRODUCING A COPPER ALLOY WIRE ROD AND COPPER ALLOY WIRE ROD

(75) Inventors: Hirokazu Yoshida, Tokyo (JP); Tsukasa Takazawa, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 1053 days.

(21) Appl. No.: 12/325,657

(22) Filed: Dec. 1, 2008

(65) Prior Publication Data

US 2009/0165902 A1 Jul. 2, 2009

Related U.S. Application Data

(63) Continuation of application No. PCT/JP2007/061201, filed on Jun. 1, 2007.

(30) Foreign Application Priority Data

Jun. 1, 2006 (JP) ..... 2006-154078
Mar. 27, 2007 (JP) ..... 2007-082886
May 31, 2007 (JP) ..... 2007-146226

(51) Int. Cl.
*C22F 1/08* (2006.01)
*B22D 11/06* (2006.01)

(52) U.S. Cl. ..... 148/554; 148/501; 148/503; 148/504; 148/508; 148/511; 148/568; 148/680; 148/681; 148/682; 148/684

(58) Field of Classification Search ..... 148/554, 148/568, 680, 681, 682, 684, 501, 503, 504, 148/508, 511
See application file for complete search history.

(56) References Cited

FOREIGN PATENT DOCUMENTS

| | | | | |
|---|---|---|---|---|
| CN | 1386873 | A | | 12/2002 |
| CN | 1458292 | A | | 11/2003 |
| CN | 1482264 | A | * | 3/2004 |
| CN | 1671877 | A | | 9/2005 |
| CN | 1688732 | A | | 10/2005 |
| JP | 49-26162 | B | | 7/1974 |
| JP | 55-128353 | A | | 10/1980 |
| JP | 56-60734 | A | | 5/1981 |
| JP | 63-045353 | A | | 2/1988 |
| JP | 2000-328152 | A | | 11/2000 |
| JP | 2000328152 | A | * | 11/2000 |
| JP | 2001-259799 | A | | 9/2001 |
| JP | 2002-028757 | A | | 1/2002 |
| JP | 2002-120050 | A | | 4/2002 |
| JP | 2004-176130 | A | | 6/2004 |
| JP | 2005-144492 | A | | 6/2005 |

OTHER PUBLICATIONS

Lei, Jing-guo, et al.; On Manufacturing Solution Polybasic Copper Alloys Rod & Wires by Continuous Casting and Rolling Process; http/www.cqvip.com, 2005, pp. 221-222. (English abstract & Full English translation).
"High Performance Copper Alloy and its Process Technology" Mar. 31, 2005.

(Continued)

*Primary Examiner* — Sikyin Ip
(74) *Attorney, Agent, or Firm* — Westerman, Hattori, Daniels & Adrian, LLP

(57) ABSTRACT

A method of producing a copper alloy wire rod, containing: a casting step for obtaining an ingot by pouring molten copper of a precipitation strengthening copper alloy into a belt-&-wheel-type or twin-belt-type movable mold; and a rolling step for rolling the ingot obtained by the casting step, which steps are continuously performed, wherein an intermediate material of the copper alloy wire rod in the mid course of the rolling step or immediately after the rolling step is quenched.

20 Claims, 5 Drawing Sheets

OTHER PUBLICATIONS

Chinese Office Action dated Oct. 27, 2010, issued in corresponding Chinese Patent Application No. 207780027446.1.
International Search Report of PCT/JP2007/061201, date of mailing Aug. 28, 2007.
Japanese Office Action dated Jul. 31, 2012 (mailing date), issued in corresponding Japanese Patent Application No. 2007-146226, with English translation (6 pages).

* cited by examiner

METHOD OF PRODUCING A COPPER ALLOY WIRE ROD AND COPPER ALLOY WIRE ROD

TECHNICAL FIELD

The present invention relates to a method of producing a precipitation strengthening copper alloy wire rod and to a copper alloy wire rod produced by the producing method.

BACKGROUND ART

As electronic equipments are getting smaller, thinning of a copper conductor has been required and oxygen-free copper excellent in ductility and processability has been increasingly used. Thus, a method of producing oxygen-free or low-oxygen copper wire rods through a belt & wheel type continuous casting and rolling high in production capacity has been proposed.

Meanwhile, it is known that a precipitation strengthening copper alloy, e.g., a Corson alloy, is remarkably brittle at an intermediate temperature. Therefore, it has been pointed out that there is a need to avoid cracks upon casting. In addition, the heating conditions before hot-rolling have to be also considered sufficiently.

Further, when the copper alloy containing a trace amount of Si or Mg is cast through the belt & wheel type continuous casting and rolling method, alloying elements are naturally oxidized and thus a large amount of slag is occurred, thereby making it difficult to produce the wire rod.

For those reasons, it has been a current state of the art that, when producing the Corson-based alloy wire rod, an ingot is first produced through low-speed casting or semi-continuous casting with a very precise cooling control, and then the resultant ingot is processed through hot working while performing the control of a temperature increasing rate and the like.

In addition, since sulfur (S) that is inevitably contained in copper alloys encourages the intermediate temperature brittleness, a trace amount of Mg, Mn, Zn, and the like is added to the copper alloy, to stabilize the sulfur and thus to prevent the intermediate temperature embrittlement.

Further, although the production of the Corson-based alloy wire rod using a movable mold has been proposed and attempted, the precipitation progresses as a quenching temperature is lowered and thus electric conductivity of the copper alloy wire rod is made high. This means that the original performance cannot be exhibited because there is short of Ni or Si required for fine precipitation contributing to strength enhancement in an aging heat treatment. In order to improve this phenomenon, there is a need to perform a solution treatment for the copper alloy wire rod, which has gone through rolling, at a high temperature for a long period of time. This results in a huge increase of the production costs for the copper alloy wire rod.

DISCLOSURE OF INVENTION

In order to significantly lowering of the production costs for the Corson-based alloy wire rod having excellent properties, there is a need to improve processability in each steps of casting, heating, and hot working. It seems that some have attempted to improve the processability, by adding a special element, such as Mg, Zn, and the like. However, this could not lead to a remarkable lowering of the production costs.

In addition, it has been appeared that methods of producing the copper alloy wire rod using the precipitation strengthening copper alloy other than Corson-based alloy have associated with the similar problems as described in the above.

Thus, the present invention is to contemplate for providing a method of producing a precipitation strengthening copper alloy wire rod (e.g., a Corson-based alloy wire rod), capable of increasing a producing speed of the copper alloy wire rod and dramatically lowering production costs. Further, the present invention is to contemplate for attaining an additional improvement of the producing speed, by preventing sulfur (S) from mixing with the alloy thereof.

It is well known that, when producing a large cross section ingot using molten metal, considerable shrinkage in volume occurs due to a phase transformation from a liquid phase to a solid phase (solidification), resulting in occurrence of crack in the ingot upon solidification. As a measure for preventing the crack, downsizing of a section of the ingot is effective. However, when the section of the ingot is downsized, the productivity is significantly obstructed. An increase of the casting velocity may be applied as a method for improving the productivity, but an air gap is actually occurred to make the primarily cooling insufficient, and thus there is a limit to increase the casting velocity. Further, in the worst case, sometimes a crucial trouble such as a breakout may occur.

The inventors have concluded through a variety of tests and a solidification simulation, and we have found that there is a need to attain a sufficient mold length allowing forming of a sufficient solidified shell even when the air gap is occurred. However, in attaining the sufficient mold length, a typical vertical continuous casting machine has a limitation that, for example, a pit of the casting machine has to be deeper or a position of the casting machine has to be higher. Thus, in order to pursue high-speed casting with a movable mold having a long primary cooling length adopted as a way to reduce equipment costs while increasing the primary cooling length, continuous hot-rolling was performed as a rolling step in a continuous casting and rolling method, in which a casting step and a rolling step are continuously performed, thereby increasing a temperature of a wire having a diameter (e.g., $\phi 8$ mm) of the copper alloy wire rod that is obtained after the rolling step. Further, we have found that a copper alloy wire rod of similar state to a copper alloy wire rod that is obtained after the solution treatment can be obtained, by quickly cooling the material (i.e., the copper alloy wire rod obtained after the rolling step). The present invention has been made based on the above-described findings.

In this specification, a copper alloy rod obtained after the casting step but before the rolling step is defined and referred to as "ingot"; and a copper alloy material after the casting, rolling, quenching steps is defined and referred to as "copper alloy wire rod." In addition, a copper alloy material in a state before "copper alloy wire rod" is obtained from the "ingot" is defined and referred to as "intermediate material of the copper alloy wire rod", for convenience.

According to the present invention, the following measures are provided:

(1) A method of producing a copper alloy wire rod, the method comprising a continuous casting and rolling step, in which a casting step for obtaining an ingot by pouring molten copper of a precipitation strengthening copper alloy into a belt-&-wheel-type (ex. SCR, Properzi) or twin-belt-type (ex. Contirod) movable mold, and a rolling step for rolling the ingot obtained by the casting step, are continuously performed, wherein an intermediate material of the copper alloy wire rod in the mid course of the rolling step or immediately after the rolling step is quenched;

(2) The method of producing a copper alloy wire rod according to (1), wherein the copper alloy contains 1.0 to 5.0% by mass of Ni, 0.25 to 1.5% by mass of Si, with the balance being composed of Cu and inevitable impurity elements;

(3) The method of producing a copper alloy wire rod according to (1), wherein the copper alloy contains 1.0 to 5.0% by mass of Ni, 0.25 to 1.5% by mass of Si, 0.1 to 1.0% by mass of at least one element selected from the group consisting of Ag, Mg, Mn, Zn, Sn, P, Fe, and Cr, with the balance being composed of Cu and inevitable impurity elements;

(4) The method of producing a copper alloy wire rod according to (1), wherein the copper alloy contains 1.0 to 5.0% by mass of Ni or Co in total, 0.25 to 1.5% by mass of Si, with the balance being composed of Cu and inevitable impurity elements;

(5) The method of producing a copper alloy wire rod according to (1), wherein the copper alloy contains 1.0 to 5.0% by mass of Ni or Co in total, 0.25 to 1.5% by mass of Si, 0.1 to 1.0% by mass of at least one element selected from the group consisting of Ag, Mg, Mn, Zn, Sn, P, Fe, and Cr, with the balance being composed of Cu and inevitable impurity elements;

(6) The method of producing a copper alloy wire rod according to (1), wherein the copper alloy contains 0.5 to 15.0% by mass of Ni, 0.5 to 4.0% by mass of Sn, with the balance being composed of Cu and inevitable impurity elements;

(7) The method of producing a copper alloy wire rod according to (1), wherein the copper alloy contains 0.5 to 15.0% by mass of Ni, 0.5 to 4.0% by mass of Sn, 0.02 to 1.0% by mass of at least one element selected from the group consisting of Ag, Mg, Mn, Zn, P, Fe, and Cr, with the balance being composed of Cu and inevitable impurity elements;

(8) The method of producing a copper alloy wire rod according to (1), wherein the copper alloy contains 0.5 to 5.0% by mass of Ni, 0.1 to 1.0% by mass of Ti, with the balance being composed of Cu and inevitable impurity elements;

(9) The method of producing a copper alloy wire rod according to (1), wherein the copper alloy contains 0.5 to 5.0% by mass of Ni, 0.1 to 1.0% by mass of Ti, 0.02 to 1.0% by mass of at least one element selected from the group consisting of Ag, Mg, Mn, Zn, Sn, P, Fe, and Cr, with the balance being composed of Cu and inevitable impurity elements;

(10) The method of producing a copper alloy wire rod according to (1), wherein the copper alloy contains 0.5 to 2.0% by mass of Cr, with the balance being composed of Cu and inevitable impurity elements;

(11) The method of producing a copper alloy wire rod according to (1), wherein the copper alloy contains 0.5 to 2.0% by mass of Cr, 0.02 to 1.0% by mass of at least one element selected from the group consisting of Ag, Mg, Mn, Zn, Sn, P, and Fe, with the balance being composed of Cu and inevitable impurity elements;

(12) The method of producing a copper alloy wire rod according to (1), wherein the copper alloy contains 0.5 to 2.0% by mass of Cr, 0.01 to 1.0% by mass of Zr, with the balance being composed of Cu and inevitable impurity elements;

(13) The method of producing a copper alloy wire rod according to (1), wherein the copper alloy contains 0.5 to 2.0% by mass of Cr, 0.01 to 1.0% by mass of Zr, 0.02 to 1.0% by mass of at least one element selected from the group consisting of Ag, Mg, Mn, Zn, Sn, P, and Fe, with the balance being composed of Cu and inevitable impurity elements;

(14) The method of producing a copper alloy wire rod according to (1), wherein the copper alloy contains 0.5 to 5.0% by mass of Fe, 0.01 to 1.0% by mass of P, with the balance being composed of Cu and inevitable impurity elements;

(15) The method of producing a copper alloy wire rod according to (1), wherein the copper alloy contains 0.5 to 5.0% by mass of Fe, 0.01 to 1.0% by mass of P, 0.02 to 1.0% by mass of at least one element selected from the group consisting of Ag, Mg, Mn, Zn, Sn, and Cr, with the balance being composed of Cu and inevitable impurity elements;

(16) The method of producing a copper alloy wire rod according to (1), wherein the copper alloy contains 0.5 to 5.0% by mass of Fe, 1.0 to 10.0% by mass of Zn, with the balance being composed of Cu and inevitable impurity elements;

(17) The method of producing a copper alloy wire rod according to (1), wherein the copper alloy contains 0.5 to 5.0% by mass of Fe, 1.0 to 10.0% by mass of Zn, 0.02 to 1.0% by mass of at least one element selected from the group consisting of Ag, Mg, Mn, P, Sn, and Cr, with the balance being composed of Cu and inevitable impurity elements;

(18) The method of producing a copper alloy wire rod according to any one of (1) to (17), wherein the casting step and the rolling step are completed within 300 seconds after pouring the molten copper of the copper alloy into the movable mold, and the intermediate material of the copper alloy wire rod is quenched at a temperature of 600° C. or higher;

(19) The method of producing a copper alloy wire rod according to any one of (1) to (17), wherein a raw material copper for the copper alloy is molten in a shaft furnace, reverberatory furnace, or induction furnace, and a deoxidation/dehydrogenation treatment is performed on the molten copper, and alloying element components are added, to form the molten copper of the copper alloy;

(20) The method of producing a copper alloy wire rod according to any one of (1) to (17), wherein the intermediate material of the copper alloy wire rod before the quenching is heated in the course of the rolling step; and

(21) A copper alloy wire rod, which is produced by the method according to any one of (1) to (20), via continuous casting and rolling of the precipitation strengthening copper alloy.

Other and further features and advantages of the invention will appear more fully from the following description, appropriately referring to the accompanying drawings.

BEST MODE FOR CARRYING OUT THE INVENTION

Figure 1:
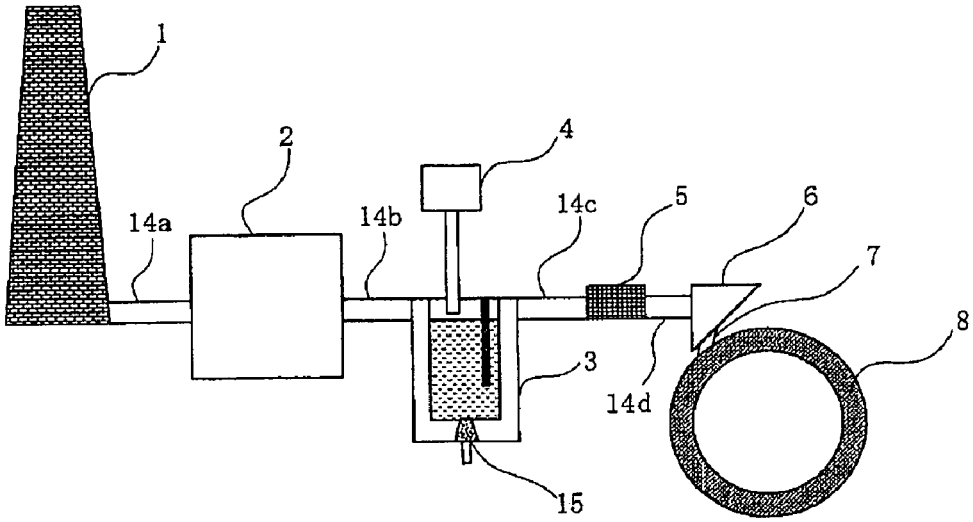
FIG. 1 is a schematic view showing an example of a belt & wheel type continuous casting and rolling apparatus that can be used in the present invention.

Hereinafter, description will be made in detail on the method of producing a copper alloy wire rod by continuously casting and rolling a precipitation strengthening copper alloy, such as Corson-based alloy. Herein, although a method of producing the Corson-based alloy (Cu—Ni—Si-based copper alloy) is illustrated in the following description as a representative example of the present invention, other alloys may be also produced in the similar manner as long as the alloys are the precipitation strengthening copper alloys.

The wire rod obtained by a producing method of the present invention is formed of a precipitation strengthening alloy, such as a Corson-based alloy. For example, the Corson-based alloy generally contains 1.0 to 5.0% by mass of Ni, 0.25 to 1.5% by mass of Si, with the balance being Cu and inevitable impurity elements.

The reason for defining a Ni content within the range of 1.0 to 5.0% by mass is to improve mechanical strength, and, as described in the below, to obtain a copper alloy wire rod, which is in a state similar or identical to a state attained after a solution treatment (i.e. solution-treated state), when an intermediate material of the copper alloy wire rod is quenched in the mid course of or immediately after the rolling step in the continuous casting and rolling machine. When the Ni content is less than 1.0% by mass, sufficient strength cannot be attained. When the Ni content is greater than 5.0% by mass, it is difficult to make the copper alloy wire rod in the solution-treated state or similar to it even when quenching is performed in the middle of or after the rolling step. The Ni content is preferably 1.5 to 4.5% by mass, more preferably 1.8 to 4.2% by mass.

Further, the reason for defining a Si content within the range of 0.25 to 1.5% by mass is to improve the strength by forming a compound together with the Ni, and, similar to the Ni as above, to obtain a copper alloy wire rod, which is in a state similar or identical to a solution-treated state, when the intermediate material of the copper alloy wire rod in the middle of or immediately after the rolling step in the continuous casting and rolling machine is quenched. When the Si content is less than 0.25% by mass, sufficient strength cannot be attained. When the Si content is greater than 1.5% by mass, it is difficult to make the copper alloy wire rod in the solution-treated state or similar to it even when quenching is performed in the middle of or after the rolling step. The Si content is preferably 0.35 to 1.25% by mass, more preferably 0.5 to 1.0% by mass.

Further, the copper alloy may further contain 0.1 to 1.0% by mass of at least one element selected from the group consisting of Ag, Mg, Mn, Zn, Sn, P, Fe, and Cr. The reason is that the strength is enhanced with the metal element(s) of an amount of 0.1 to 1.0% by mass is contained. When the element content is less than 0.1% by mass, the strength enhancement is not sufficient, while when the element content is greater than 1.0% by mass, it is difficult to make the copper alloy wire rod in the solution-treated state even when quenching is performed on the intermediate material of the copper alloy wire rod in the middle of or immediately after the rolling step. The content of the above at least one element is preferably 0.11 to 0.8% by mass, more preferably 0.12 to 0.6% by mass.

Furthermore, in the copper alloy, some or even all in the case may be of the Ni content may be replaced with Co. In that case, total amount of the contained Ni and Co is within the range of 1.0 to 5.0% by mass (preferably 1.5 to 4.5% by mass, more preferably from 1.8 to 4.2% by mass). The Co exhibits the same effect as the Ni in forming a compound together with the Si, thereby contributes to the strength improvement. By adding these elements, the property of the wire rod attained after the aging treatment can be improved. However, it has been found that the performance, such as a mechanical property (strength), after the aging treatment can be basically controlled, by managing a quenching temperature in the mid course of or immediately after the rolling step.

Further, in addition to the aforementioned Corson alloy, examples of the copper alloy, to which the copper alloy wire rod producing method of the present invention can be applied, include: (1) a copper alloy containing 0.5 to 15.0% by mass (preferably 1.0 to 13.0% by mass, more preferably 4.0 to 10.0% by mass) of Ni, 0.5 to 4.0% by mass (preferably 0.7 to 4.0% by mass, more preferably 2.0 to 4.0% by mass) of Sn, with the balance being composed of Cu and inevitable impurity elements; (2) a copper alloy containing 0.5 to 15.0% by mass (preferably 1.0 to 13.0% by mass, more preferably 4.0 to 10.0% by mass) of Ni, 0.5 to 4.0% by mass (preferably 0.7 to 4.0% by mass, more preferably 2.0 to 4.0% by mass) of Sn, 0.02 to 1.0% by mass (preferably 0.05 to 0.8% by mass, more preferably 0.1 to 0.8% by mass) of at least one element selected from the group consisting of Ag, Mg, Mn, Zn, P, Fe, and Cr, with the balance being composed of Cu and inevitable impurity elements; (3) a copper alloy containing 0.5 to 5.0% by mass (preferably 1.0 to 5.0% by mass, more preferably 2.0 to 4.5% by mass) of Ni, 0.1 to 1.0% by mass (preferably 0.2 to 0.8% by mass, more preferably 0.5 to 0.8% by mass) of Ti, with the balance being composed of Cu and inevitable impurity elements; (4) a copper alloy containing 0.5 to 5.0% by mass (preferably 1.0 to 5.0% by mass, more preferably 2.0 to 4.5% by mass) of Ni, 0.1 to 1.0% by mass (preferably 0.2 to 0.8% by mass, more preferably 0.5 to 0.8% by mass) of Ti, 0.02 to 1.0% by mass (preferably 0.05 to 0.8% by mass, more preferably 0.1 to 0.8% by mass) of at least one element selected from the group consisting of Ag, Mg, Mn, Zn, Sn, P, Fe, and Cr, with the balance being composed of Cu and inevitable impurity elements; (5) a copper alloy containing 0.5 to 2.0% by mass (preferably 0.5 to 1.5% by mass, more preferably 0.5 to 1.2% by mass) of Cr, with the balance being composed of Cu and inevitable impurity elements; (6) a copper alloy containing 0.5 to 2.0% by mass (preferably 0.5 to 1.5% by mass, more preferably 0.5 to 1.2% by mass) of Cr, 0.02 to 1.0% by mass (preferably 0.05 to 0.8% by mass, more preferably 0.1 to 0.8% by mass) of at least one element selected from the group consisting of Ag, Mg, Mn, Zn, Sn, P, and Fe, with the balance being composed of Cu and inevitable impurity elements; (7) a copper alloy containing 0.5 to 2.0% by mass (preferably 0.5 to 1.5% by mass, more preferably 0.5 to 1.2% by mass) of Cr, 0.01 to 1.0% by mass (preferably 0.1 to 1.0% by mass, more preferably 0.2 to 0.8% by mass) of Zr, with the balance being composed of Cu and inevitable impurity elements; (8) a copper alloy containing 0.5 to 2.0% by mass (preferably 0.5 to 1.5% by mass, more preferably 0.5 to 1.2% by mass) of Cr, 0.01 to 1.0% by mass (preferably 0.1 to 1.0% by mass, more preferably 0.2 to 0.8% by mass) of Zr, 0.02 to 1.0% by mass (preferably 0.05 to 0.8% by mass, more preferably 0.1 to 0.8% by mass) of at least one element selected from the group consisting of Ag, Mg, Mn, Zn, Sn, P, and Fe, with the balance being composed of Cu and inevitable impurity elements; (9) a copper alloy containing 0.5 to 5.0% by mass (preferably 1.0 to 4.5% by mass, more preferably 2.0 to 4.0% by mass) of Fe, 0.01 to 1.0% by mass (preferably 0.1 to 0.5% by mass, more preferably 0.2 to 0.5% by mass) of P, with the balance being composed of Cu and inevitable impurity elements; (10) a copper alloy containing 0.5 to 5.0% by mass (preferably 1.0 to 4.5% by mass, more preferably 2.0 to 4.0% by mass) of Fe, 0.01 to 1.0% by mass (preferably 0.1 to 0.5% by mass, more preferably 0.2 to 0.5% by mass) of P, 0.02 to 1.0% by mass (preferably 0.05 to 0.8% by mass, more preferably 0.1 to 0.8% by mass) of at least one element selected from the group consisting of Ag, Mg, Mn, Zn, Sn, and Cr, with the balance being composed of Cu and inevitable impurity elements; (11) a copper alloy containing 0.5 to 5.0% by mass (preferably 1.0 to 4.5% by mass, more preferably 2.0 to 4.0% by mass) of Fe, 1.0 to 10.0% by mass (preferably 2.0 to 10.0% by mass, more preferably 2.0 to 8.0% by mass) of Zn, with the balance being composed of Cu and inevitable impurity elements; (12) a copper alloy containing 0.5 to 5.0% by mass (preferably 1.0 to 4.5% by mass, more preferably 2.0 to 4.0% by mass) of Fe, 1.0 to 10.0% by mass (preferably 2.0 to 10.0% by mass, more preferably 2.0 to 8.0% by mass) of Zn, 0.02 to 1.0% by mass (preferably 0.05 to 0.8% by mass, more preferably 0.1 to 0.8% by mass) of at least one element selected from the group consisting of Ag, Mg, Mn, P, Sn, and Cr, with the balance being composed of Cu and inevitable impurity elements.

Next, the following will describe the method of the present invention for producing a copper alloy wire rod. In the producing method of the present invention, a belt & wheel type or twin belt type movable mold is preferably used.

Regarding the method of the present invention of producing a copper alloy wire rod, a variety of examples of embodiments according to the present invention will now be described, with reference to the accompanying drawings. Herein, the same reference numbers designate the same elements throughout the figures and specification, and the description of the same elements are omitted not to duplicate.

FIG. 1 is a schematic view showing an example of a continuous casting and rolling apparatus using a belt & wheel type movable mold, which can be used in the present invention (herein, only a continuous casting machine is illustrated, and a hot rolling mill and a quenching machine are not illustrated).

As shown in FIG. 1, a raw material copper is molten in a shaft furnace 1 at a temperature of 1,090 to 1,150° C. The molten copper is tapped to a holding furnace 2 through a gutter 14*a* from the shaft furnace 1, and then the molten copper in the holding furnace 2 is further tapped to the induction furnace 3 through a gutter 14*b*, while retention in the holding furnace 2 at a temperature of 1,100 to 1,200° C. Subsequently, alloying element components are added from an adding apparatus 4 to the molten copper in the induction furnace 3 so as to adjust to form a predetermined alloy composition, followed by melting the same.

Among the above-mentioned copper alloys, Corson alloy molten metal, for example, contains Si or the like with high affinity for oxygen, and thus when molten, oxygen potential in the molten copper is very low and then, on the contrary, hydrogen potential in the molten copper is high. Therefore, when using such a copper alloy, it is preferable to perform the dehydrogenation treatment on the molten copper in the induction furnace in advance (see a deoxidation/dehydrogenation unit 13 in FIGS. 2 to 6, which will be described in the below). In addition, an oxide having low wettability with the alloy molten metal is adsorbed and removed by bubbles occurred by a porous plug 15. In order to prevent the oxidation of the element having the high affinity for oxygen, such as Si, in the molten copper, it is preferable to cover an upper space in the gutter 14 with inertia gas or reducing gas. However, since there is risk of trouble such as break down of obtained wire product if even a few oxide is drawn into the ingot, a ceramic filter 5 is preferably installed in gutters 14*c* and 14*d*. Herein, the flow of the molten copper right before the filter 5 in the gutter 14*c* is preferably 10,000 or less, and more preferably 3,000 or less in terms of the Reynolds number.

The molten copper from the induction furnace 3 is continuously transferred into a casting pot 6 through the gutters 14*c* and 14*d*. The molten metal in the pot in a state sealed by inertial gas or reducing gas is poured to the belt & wheel type casting machine 8, which is a rotationally movable mold, through a immersed nozzle 7 and is subsequently solidified.

Figure 6:
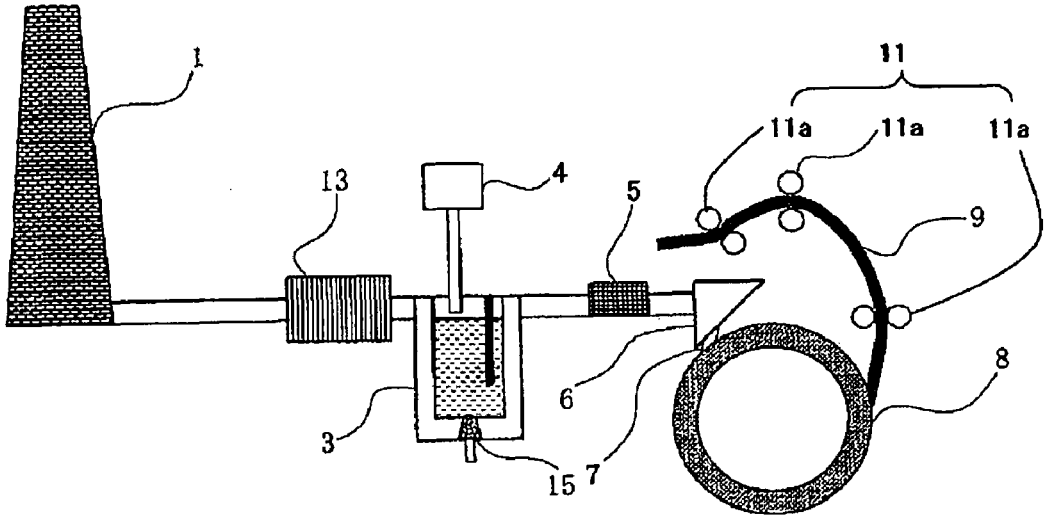
FIG. 6 is a schematic view showing still another example of a belt & wheel type continuous casting and rolling apparatus that can be used in the present invention.
Figure 7:
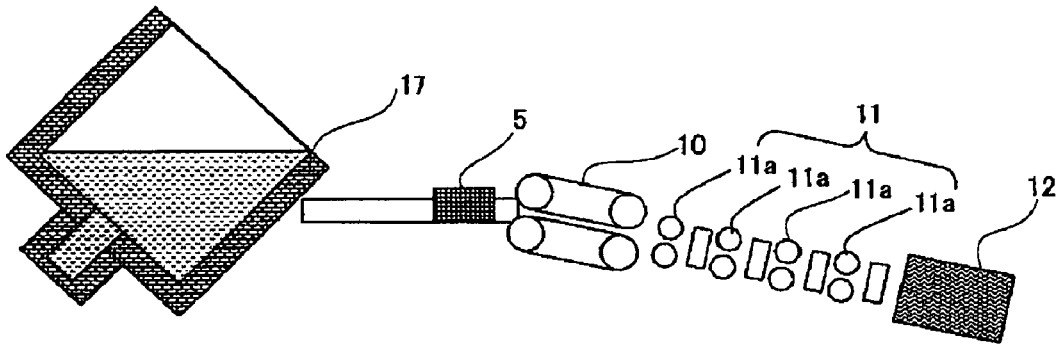
FIG. 7 is a schematic view showing an example of a twin belt type continuous casting and rolling apparatus that can be used in the present invention.

The thus-solidified ingot in a state where a temperature is maintained as high as possible (preferably 900° C. or higher), is rolled in a continuous hot rolling mill (2-way rolling, preferably 3-way rolling) to have a predetermined wire diameter, to obtain an intermediate material of the copper alloy wire rod. The continuous hot rolling mill is schematically illustrated in FIGS. 6 and 7. Referring to FIG. 6, the ingot 9 is rolled by a 2-way rolling mill 11. Referring to FIG. 7, the ingot 9 is rolled by a 3-way rolling mill 11. For the continuous casting and rolling step, it is preferable that both of the casting and rolling steps are completed within 300 seconds after pouring the material into the mold. It is further preferable that the processing time for performing a series of steps from the casting to the rolling and through to the production of a coil of the copper alloy wire rod that is a final product of the continuous casting and rolling step, is within 300 seconds.

The thus-obtained intermediate material of the copper alloy wire rod is quenched at a temperature of 600° C. or higher, preferably 700° C. or higher, more preferably 800° C. or higher. The quenching can be performed by quick cooling of the intermediate material at a cooling speed that does not allow intermetallic compound to precipitate, in a cooling apparatus disposed behind the continuous rolling mill. Alternatively, the cooling apparatus may be installed in the middle of the continuous rolling mill. According to the producing method of the present invention, a copper alloy wire rod that is substantially in solution-treated state can be obtained, and thus the solution treatment (e.g., a heat treatment step such as maintaining at 900° C. for 30 minutes) that has been indispensable in a conventional producing method, can be eliminated. In addition, sufficient precipitation of the intermetallic compound is possible upon the aging step.

Another example of an apparatus configuration performing the continuous casting and rolling according to the method of the present invention will be further described with reference to the accompanying drawings.

Figure 2:
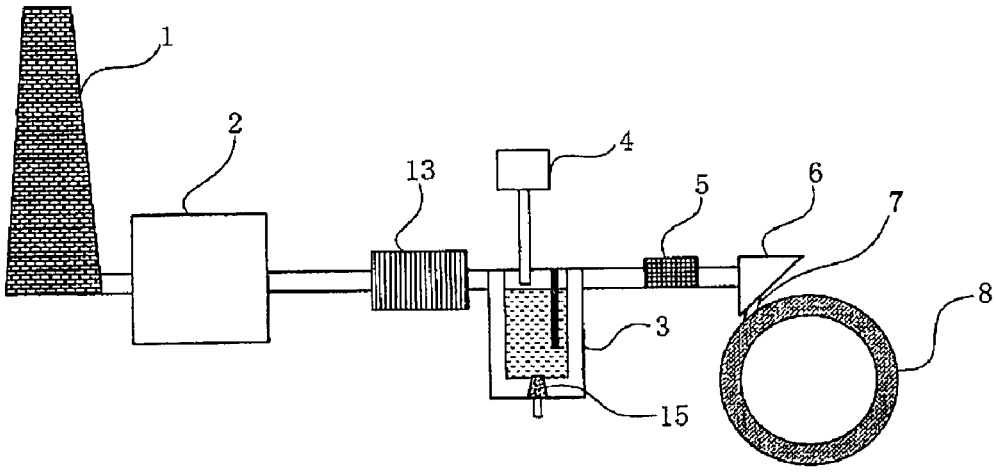
FIG. 2 is a schematic view showing another example of a belt & wheel type continuous casting and rolling apparatus that can be used in the present invention.

An apparatus shown in FIG. 2 is obtained by further providing a deoxidation/dehydrogenation unit 13 in the apparatus shown in FIG. 1. The apparatus of FIG. 2 is same as the apparatus of FIG. 1, except for the installation of the deoxidation/dehydrogenation unit 13.

The deoxidation treatment can be performed as follows. Granular charcoal is disposed in the deoxidation treatment unit 13 and an inner lid is closed. In this state, the deoxidation/dehydrogenation treatment chamber 13 is heated by a gas burner. The molten copper is tapped from the holding furnace 2 when the interior of the deoxidation/dehydrogenation chamber 13 and the charcoal are red heated. As the molten copper passes through the deoxidation treatment unit 13 with bypassing, the oxygen contained in the molten copper is brought into reaction with the granular charcoal, to be carbon dioxide gas. The resultant carbon dioxide gas rises toward a surface side of and then discharged from the molten copper.

Figure 9:
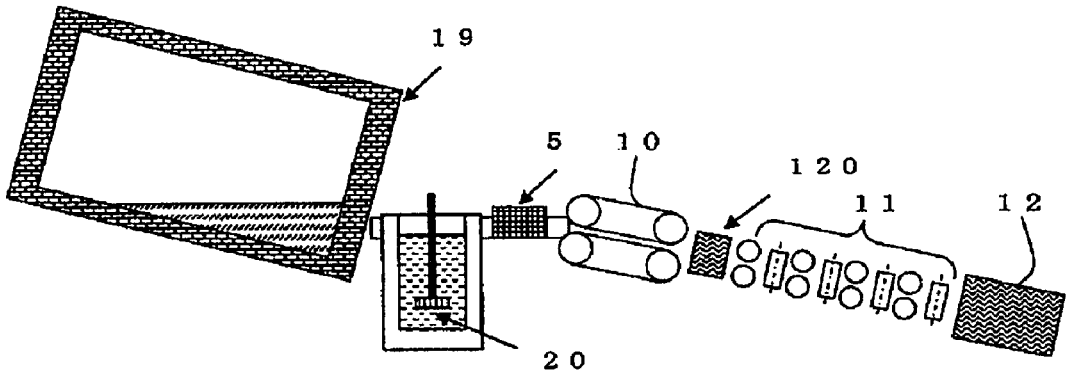
FIG. 9 is a schematic view showing another example of a twin belt type continuous casting and rolling apparatus that can be used in the present invention.

The dehydrogenation treatment may be performed by a degassing unit that allows the molten copper to contact non-oxidizing gas by allowing the molten copper to pass in a gutter, which is maintained in a non-oxidizing gas atmosphere and making the molten metal to bypass to go up and down or left and right in the gutter. Alternatively, the deoxidation treatment may be preformed, for example, through a method of blowing an inert gas or reducing gas with hydrogen concentration 0.4% or less into the molten copper using a porous plug; a method of blowing the same gas using a rotor (the reference number 20 in FIG. 9 indicates a rotating degassing apparatus); or a method of refluxing the molten copper in a vacuum. The dehydrogenation treatment may be performed after or simultaneously with the deoxidation treatment.

The apparatuses shown in FIGS. 1 and 2 are designed to give the molten copper of the copper alloy, by supplying the alloying elements from the adding apparatus 4 to the induction furnace 3, to adjust the alloy composition to be a predetermined one. Meanwhile, in the copper alloy composition, Ni has a greater density than the molten copper of the raw material copper, and Si has a less density than the molten copper of the raw material copper. Thus, when the Ni is added to the molten copper in a standing state or to the molten copper flow in a laminar flow state, the Ni settles to the bottom, and, on the other hand, the Si forms a high concentration region near a surface of the molten copper. Therefore, it is preferable to add Ni particles that can be molten before they settle to the bottom, and more preferable to add coarse-grained Ni or Si to the molten copper while agitating the molten copper by a machine, gas, or electromagnetic induction.

In addition, when Si quite high in affinity for oxygen is added, the oxygen concentration of the molten copper is necessary to reduce to 100 ppm or less, preferably 10 ppm or less, in advance. The reason is to prevent the Si from reacting with oxygen in the molten copper to form $SiO_2$ on the surface of additives and thus obstructing the continuous solution.

Figure 3:
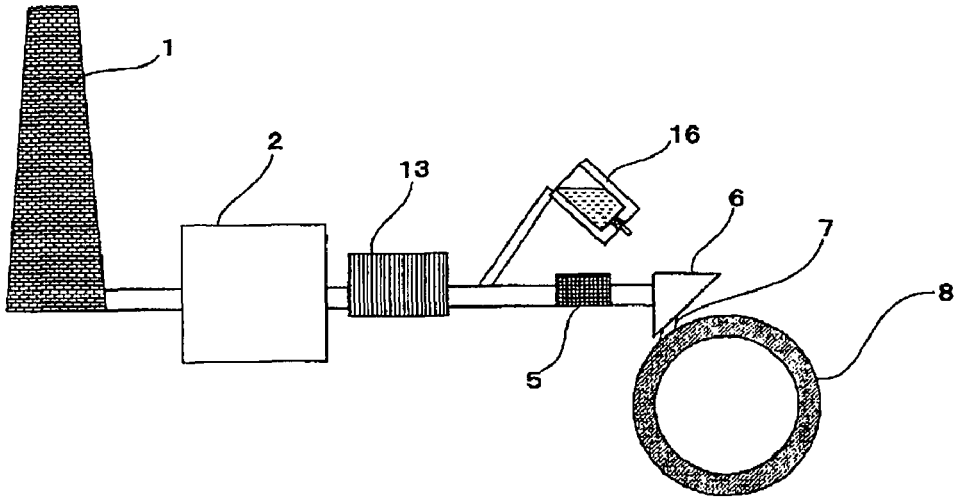
FIG. 3 is a schematic view showing still another example of a belt & wheel type continuous casting and rolling apparatus that can be used in the present invention.
Figure 4:
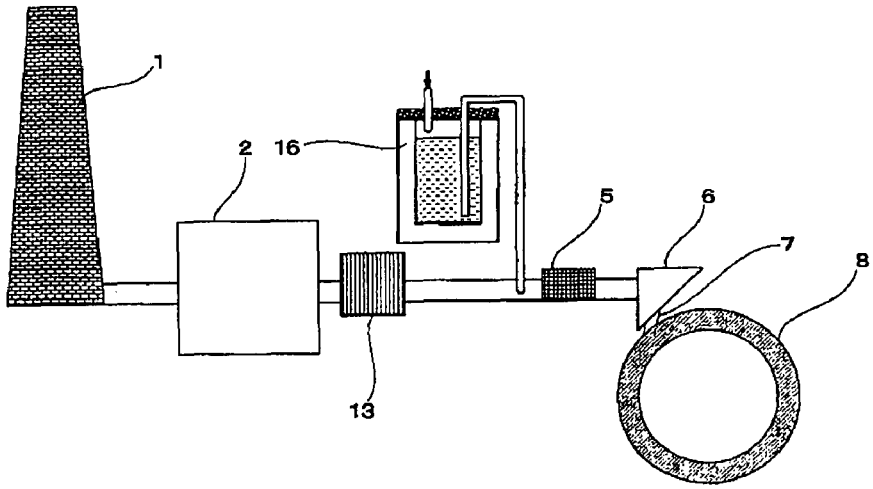
FIG. 4 is a schematic view showing still another example of a belt & wheel type continuous casting and rolling apparatus that can be used in the present invention.

Further, as shown in FIGS. 3 and 4, it is preferable that a copper alloy molten copper containing high concentration alloy components is produced in a separate line in an exclusive high concentration molten copper producing furnace 16, and then the resultant is continuously blended with a molten copper of the raw material copper. This is because that, if metallic Si, a Si—Cu master alloy, Si—Ni—Cu master alloy, or a Si—Ni—Co—Cu master alloy is added in a state where a trace amount of oxygen remains in the molten copper, a Si oxide is formed on the surface of the additives and thus the continuous melting is obstructed. As a method of continuously adding the high concentration copper alloy molten copper to the molten copper of the raw material copper, a tilting control of the high concentration molten copper producing furnace as shown in FIG. 3 may be performed. The pressure tapping control by pressurization as shown in FIG. 4 is preferable, since the oxidation can be prevented and the precision of the flow rate control of the molten copper is high.

As described in the above, the molten metal in the casting pot in a state sealed by the inert gas or reducing gas is poured from the immersed nozzle to the rotationally movable mold and is subsequently solidified. In such a process, the atmospheric gas sealing the molten metal is drawn into the molten copper in the mold. In order to prevent the atmospheric gas from being drawn into the molten copper, a front end of the immersed nozzle is immersed in the molten copper. However, in this manner, the molten metal is attached to the vicinity of the front end of the immersed nozzle and grown around thereof, and it is not possible to conduct the stable casting for a long time period. Thus, an induction coil is disposed at an outer side of the immersed nozzle and induction-heating is performed on the electrically conductive immersed nozzle, thereby preventing the attachment and growing of the metal.

Preferably, it is also effective to use the hydrogen as the reducing gas. In this case, since a temperature of the molten copper in the mold is almost same as the liquidus temperature, the hydrogen is not absorbed so much. Further, even if the hydrogen gas drawn in the molten copper is trapped in the solidified shell, and thus the ingot has a coarse-grained void, this can be cured as the hydrogen is dispersed in the solid upon the subsequent hot rolling step.

Figure 5:
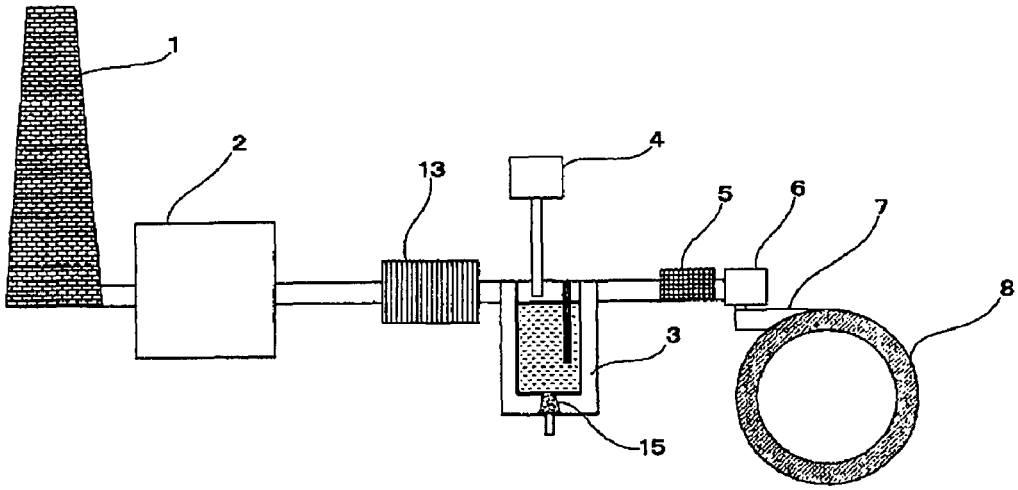
FIG. 5 is a schematic view showing still another example of a belt & wheel type continuous casting and rolling apparatus that can be used in the present invention.

More preferably, when pouring the molten copper containing Si high in affinity for oxygen, to the belt & wheel casting machine, as shown in FIG. 5, the immersed nozzle 7 adopts a horizontal pouring manner, to avoid the contact with the atmospheric air, thereby preventing the occurrence of oxides, and thus preventing the oxides from being drawn into the ingot.

An apparatus shown in FIG. 6 is same as the apparatus of FIG. 2, except that it has no holding furnace 2. The apparatus of FIG. 6 is designed such that the ingot 9 is rolled by the rolling mill 11. The rolling mill 11 includes a plurality of rolls 11*a* that are arranged in series. In FIG. 6, the rolls 11*a* exhibit a 2-way rolling, but the rolls may be of 3-way rolling or other manner. In the present invention, the holding furnace is not always necessary, if capacity of the induction furnace 3 is large. The reason is that the variation of the discharge of the molten copper from the shaft furnace 1 can be sufficiently absorbed, which leads that eliminating the holding furnace allows simplifying the process and reducing the production costs further.

FIG. 7 illustrates an example using a twin belt type movable mold 10 as the movable mold that can be used in the present invention. As the melting furnace, a channel furnace 17, a reverberatory furnace 19 shown in FIG. 9, or a crucible induction furnace (not shown) may be used not only with the twin belt type casting machine 10 but also with a belt & wheel type casting machine 8. The furnace having the shaft furnace 1, the holding furnace 2, and the induction furnace 3 that are illustrated in FIG. 1 and the like, may be followed by the twin belt type movable mold 10. In FIG. 7, the reference number 11 indicates a rolling mill having a plurality of rolls 11*a* that are arranged in series, and the reference number 12 indicates the quenching machine.

Figure 10:
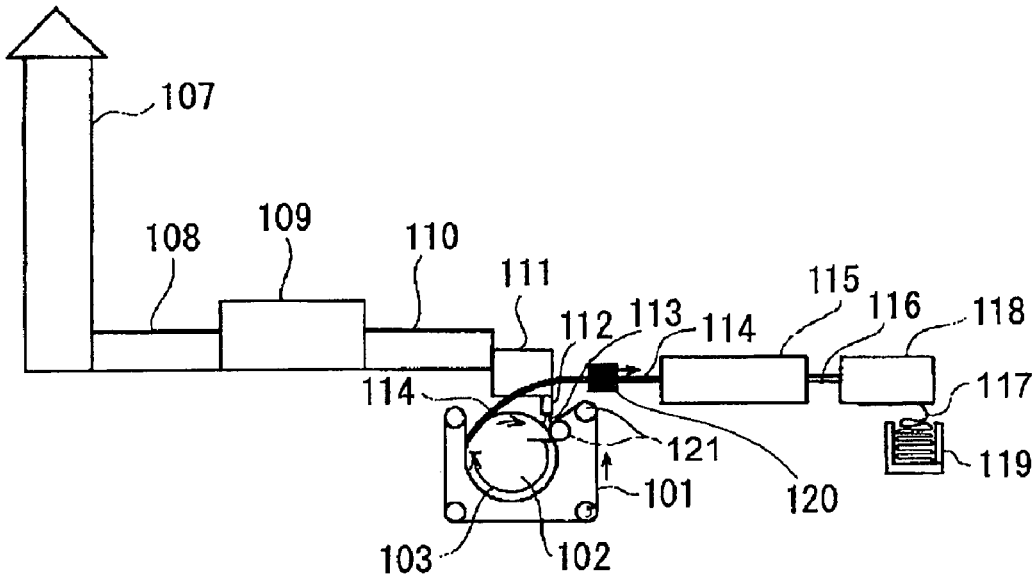
FIG. 10 is an overall schematic view showing still another example of a belt & wheel type continuous casting and rolling apparatus that can be used in the present invention.

FIG. 10 is a schematic view illustrating an overall system using the belt & wheel type continuous casting and rolling apparatus that can be used in the method of the present invention of producing the copper alloy wire rod. A rotationally movable mold 103 includes a belt 101 and a wheel 102 that are guided by guide rolls 121.

The molten copper melted in a shaft furnace 107 passes through a gutter-a 108 and mixed with the alloying element components added from an adding unit (not shown), and then the resulting material is made into a molten copper alloy of a predetermined alloy component in an induction furnace 109. The resultant molten copper alloy 113 is transferred to the casting pot 111 through a gutter-b 110, poured from a immersed nozzle 112 to the rotationally movable mold 103, followed by solidification to form an ingot 114. The ingot 114 is rolled by the continuous rolling mill 115, and thus an intermediate material of a copper alloy wire rod 116 is obtained. The intermediate material of the copper alloy wire rod 116 is quenched in a quenching machine 118, and thus the copper alloy wire rod 117 is obtained. The reference number 119 indicates a pallet for containing the copper alloy wire rod 117.

Further, since there is a case where a temperature of the ingot 114 is lowered, it is also preferable that a high frequency induction heating apparatus 120 is provided in front of and in the mid course of the continuous rolling mill 115. It is preferable that the continuous rolling mill 115 has, as shown in FIGS. 6 and 7, a plurality of rolls arranged in series, because the high frequency induction heating apparatus 120 can be readily installed in front of or in the mid course of the continuous rolling mill 115.

Further, since it is important to make a size of micro precipitates in the alloy upon the solidification of the wire rod fine, also in order to improve the properties of the wire rod, the ingot is solidified at a cooling rate of 1° C./second or more (preferably 3° C./second or more). The conventional tough pitch copper and the like are solidified at a higher cooling rate, however, since the alloy that is the subject in the present invention is low in thermal conductivity, the above value is the optimal cooling rate. In addition, when supplying the ingot to the hot rolling mill, there may be a case where the ingot has a fine crack on a surface thereof due to the curving of the ingot. In order to completely prevent such a surface crack on the material, it is preferable to supply the ingot to the hot rolling mill after varying an advancing direction of the ingot by passing the ingot through a differential speed rolling rolls.

Further, as shown in FIG. 7, in use of the twin belt type mold, it is preferable that the hot rolling mill is installed at the same inclination angle as an inclined casting machine.

Furthermore, in order to improve the producing speed, the producing capacity, and production costs, it is preferable to use the continuous melting manner using the shaft furnace as described above, from the viewpoints that the carrying-over of sulfur (S) from a cathode (an electrolytic copper) can be avoided when the cathode is molten as a raw material (S is removed through low oxidation melting), and that the productivity is further improved. When elements (Cu, Ni, and the like) low in affinity for oxygen are molten, it is required to take care of charging order of the elements for the uniformity as much as possible. However, since the contamination in the shaft furnace cannot be ignored, it is preferable to melt only the cathode and copper scrap according to the cathode. The molten copper discharged from the shaft furnace contains oxygen in an amount of about 30 to 300 ppm, and it is generally controlled to contain the oxygen in an amount of approximately 100 ppm (see Journal of the Japan Copper and Brass Research Association, vol. 40 (2001) p. 153). When the element high in affinity for oxygen, such as Si, is added to the molten copper, the added element causes oxidation loss. Thus, before the element is added, it is preferable to perform a deoxidation/dehydrogenation treatment for the molten copper to allow the molten copper to contain oxygen in an amount of 10 ppm or less and hydrogen in an amount of 0.3 ppm or less. In a process after performing the deoxidation/dehydrogenation treatment, it is necessary to seal the surface of the molten copper with a solid reducing agent, an inert gas, or a reducing gas.

Since the Corson-based alloy that can be used as an example of the precipitation strengthening alloy in the copper alloy wire rod producing method of the present invention, is an alloy having higher concentrations of metal elements, such as Ni, Si, and the like, as compared with copper and the conventional copper alloy that are cast through the belt & wheel or twin belt manner, the following two methods are adopted to conduct the continuous melting of the added elements.

One of them is to add elements to be added of concentration as high as possible and, if possible, a simple substance, thereby the amount of heat required for increasing a temperature of the material can be reduced. In addition, by using the diffusion melting principle, the element such as Ni can be continuously molten. Further, as it is experimentally identified that a heat of mixing corresponding to a latent heat occurs when the elements are added, it is known that the temperature of the molten copper is not easily lowered.

However, it is preferable to provide the induction furnace, to raise the temperature at an area where the molten copper temperature at an initial or early stage of casting is low.

Further, when accelerating the diffusion melting, in order not to make a relative speed of the molten copper to the added metals zero, it is preferable that the agitation by the porous plug 15 from the bottom of the furnace as shown in FIG. 1 and the like, or a rotary type degassing apparatus that is used for processing an aluminum alloy is also provided. Typical examples of the rotary type degassing apparatus include A622 (trade name) from Alcoa, and SNIF (trade name) from Union Carbide. When the induction furnace is installed, it is possible to recycle scrap, by adding positively the scrap occurred in the own factory.

Further, in the conventional method, for example, as illustrated in FIGS. 1 and 2 of JP-A-55-128353 ("JP-A" means unexamined published Japanese patent application), additive metal is charged into the molten copper from a vertical portion (9) of a transferring gutter (7). In order to completely melt the additive metal in a downstream charging container (8), there is a need to use a very fine metal material to enlarge the surface area to be melted by diffusion. However, the use of the fine metal material increases the production costs. In addition, when fine metal particles or powders each having a diameter less than 1 mm are added, the metal particles or powders aggregates in the molten copper and thus the sufficient melting cannot be realized. Contrary to the above, the method of the present invention can produce the copper alloy wire rod at low cost without causing such problems.

Further, in the present invention, when the induction furnace 3 or the high concentration molten copper producing furnace 16 cannot be provided due to a shortage of a site for facility, the temperature of the molten copper can be prevented from lowering, by heating the additive metal to a temperature near to the molten copper in advance, and then adding the heated additive metal to the molten copper. In that case, Cu—Ni or Cu—Si may be used as master alloy. However, when a multi-component master alloy, such as Cu—Ni—Si and the like, is used, the melting can be more effectively realized. Also in that case, it is preferable to provide the agitation by the porous plug 15 or the rotary type degassing apparatus that is used for processing an aluminum alloy, in combination.

For the belt & wheel casting method, in order to conduct stable growth of the solidified shell, electric conductivity of the mold is preferably 80% or less, more preferably 50% or less. This allows preventing deterioration of an ingot surface quality due to a non-uniform thickness of a mold release agent that is applied to prevent baking of a wheel mold or to improve an ingot quality.

Further, in the twin belt casting method or belt & wheel casting method, it is preferable to control the initial cooling, by calculating an amount of heat removal from a cooling water temperature difference {ΔT=(Drainage temperature)−(Cooling water temperature} when a wheel and a belt are cooled, calculating a ratio (R) between the thus-calculated cooling water temperature difference and a total amount of heat brought in by the molten copper, with the following equation (1), and then controlling the ratio (R) to be 0.34 to 0.51, more preferably 0.37 to 0.43.

$$R=(\Delta T\times V+A)\div\{W\times(H+T+C)\} \quad (1)$$

[In the formula (1), ΔT is the cooling water temperature difference, V is a cooling water flow rate ($m^3$/hr), W is a casting rate (kg/hr), H is a latent heat (kcal/kg), T is a casting temperature (° C.), C is a specific heat (kcal/kg·° C.), and A is an amount of evaporation heat (kcal/hr).]

Further, when the R is greater than 0.51, the quenching at 600° C. or higher can be realized, by providing the high frequency induction heating apparatus 120 shown in FIG. 10.

Finally, when quenching the hot-rolled material, it is economically preferable to remove an oxide layer (copper oxide, $SiO_2$, and other additive element oxides) formed on the surface of the wire rod. In more detail, the oxide formed on the surface can be readily removed by dipping forcedly the high temperature wire rod into water containing alcohol or mineral acid (i.e. pickling).

Although there is no specific problem if the cooling medium is in a standing state, it is preferable that the cooling medium is in a turbulent flow state. When the copper alloy wire rod is further peeled, peeling means is not specifically limited, but, for example, water dipping means may be used without any trouble as the peeling means.

Since the copper alloy according to the present invention has a wider range of the solid-and-liquid coexisting temperature as compared to tough pitch copper, and it is large in apparent viscosity, porosity occurs in a final solidified portion. If the porosity remains in the copper alloy wire rod, breakage of the wire occurs upon a wire drawing step.

Figure 8:
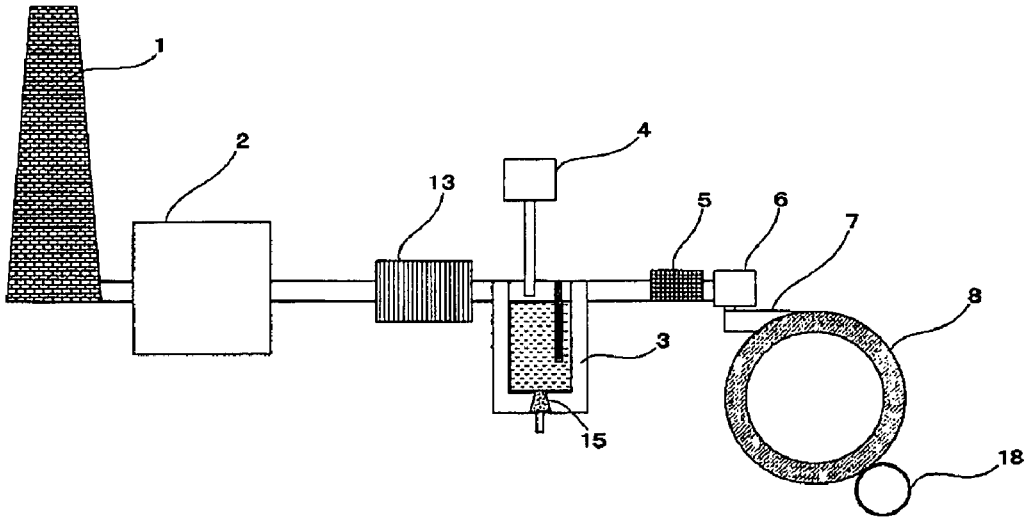
FIG. 8 is a schematic view showing an example of a belt & wheel type continuous casting and rolling apparatus provided with a reduction roll that can be used in the present invention.

Thus, as shown in FIG. 8, it is preferable to remove the porosity by applying pressure with a rolling-down roll 18 or the like for reduction by 0.2 mm or more, from an outer side of a steel belt to an area where 20% of a cross-sectional area of the ingot in the movable mold is not completely solidified.

Further, for the 2-way rolling, the porosity can be reduced by applying reduction in the initial three passes at the time of hot-rolling the ingot, such that an area reduction rate, [{(Initial cross section area of the ingot)−(Area after 3-pass rolling)}÷(Initial area of the ingot)], is 60% or more, more preferably 75% or more. For the 3-way rolling, the porosity can be reduced by applying reduction such that the area reduction rate would be 30% or more, more preferably 50% or more.

According to the present invention, copper alloy wire rods in solution-treated state can be produced with a continuous casting and rolling apparatus, which continuously perform a casting step and a rolling step, without performing any separate heating for solution treatment to wire rods formed from precipitation strengthening alloys, such as precipitation hardening Corson alloys; and thus wire rods of precipitation strengthening alloys, such as precipitation hardened Corson alloy, can be produced in a shorter time period in a mass scale at a lower cost, which are followed by drawing and aging treatment in a usual manner. As a result, for example, wire harnesses not as expensive as the conventional ones can be produced and supplied in a large quantity.

Further, according to the present invention, a sectional-area of the ingot can be reduced, and miniaturization of the rolling mill can be realized.

EXAMPLE

The present invention will be described in more detail based on the following examples, but the invention is not intended to be limited thereto.

Example 1

Copper alloy wire rods having listed wire diameters were produced, by using copper alloys having an alloy composition as shown in Table 1 and using a variety of continuous casting and rolling apparatuses as shown in Table 1. The copper alloy wire rods produced by the method of the present invention are shown in Nos. 1 to 16. Some of the wire rods having the same compositions (Nos. corresponding to are shown in ( )) as those of Nos. 1 to 16 but obtained at different quenching temperature, are shown in Nos. 17 to 23 as comparative examples.

The electric conductivity of the solution-treated state was measured by measuring electric conductivity of one, which is obtained by quickly cooling in water after maintaining at a temperature of {(solidus temperature)−10° C.} for 1 hour, through a four-prove method. The electric conductivity of the copper alloy wire rod was measured by measuring the electric conductivity of each of the obtained copper alloy wire rods through the four-prove method. Based on these values, a solution-treated rate was calculated according to an equation and listed:

[(Solution-treated rate)=(Electric conductivity of the solution-treated state)÷(Electric conductivity of the copper alloy wire rod)×100]

The solution-treated rate calculated according to the equation is a value used as an indication related to mechanical strength of the copper alloy wire rod after an aging treatment. When the solution-treated rate is 80% or more (preferably 85% or more, more preferably 90% or more), there is no need to perform a separate solution treatment after producing the copper alloy wire rod (before the aging treatment). When the solution-treated rate is 70% or more, there is a case where a separate solution treatment is not necessary after producing the copper alloy wire rod depending on the required properties thereof. When the solution-treated rate is less than 70%, there is a need to perform the separate solution treatment after producing the copper alloy wire rod.

Herein, in the casting machine column in Table 1, SCR and Properzi each indicate a belt & wheel type casting machine, and Contirod indicates a twin belt type casting machine. In the rolling mill column in Table 1, 2-way and 3-way indicate a 2-way rolling mill and a 3-way rolling mill, respectively.

TABLE 1

| No. | Alloy composition | Castor | Casting rate (ton/hr) | Rolling mill | Diameter of wire rod (mm) | Quenching temperature (° C.) | Solution-treated rate (%) |
|---|---|---|---|---|---|---|---|
| 1 | Cu—1.1Ni—0.3Si | SCR | 5 | 2-way | 8 | 630 | 94 |
| 2 | Cu—2.5Ni—0.6Si | SCR | 5 | 2-way | 6 | 670 | 85 |
| 3 | Cu—4.7Ni—1.3Si | SCR | 5 | 2-way | 6 | 690 | 87 |
| 4 | Cu—3.7Ni—0.9Si—0.1Mg—0.2Mn | SCR | 15 | 2-way | 8 | 780 | 94 |

TABLE 1-continued

| No. | Alloy composition | Castor | Casting rate (ton/hr) | Rolling mill | Diameter of wire rod (mm) | Quenching temperature (° C.) | Solution-treated rate (%) |
|---|---|---|---|---|---|---|---|
| 5 | Cu—1.1Ni—0.3Si—0.2Sn | Properzi | 10 | 3-way | 6 | 700 | 87 |
| 6 | Cu—2.7Ni—0.6Si—0.3Sn—1Zn | Properzi | 10 | 3-way | 8 | 710 | 88 |
| 7 | Cu—4.8Ni—1.3Si—0.12Ag | Properzi | 8 | 3-way | 6 | 700 | 90 |
| 8 | Cu—1.1Ni—0.4Si—0.1Mg—0.2Mn | Contirod | 20 | 2-way | 8 | 810 | 94 |
| 9 | Cu—2.3Ni—0.6Si—0.5Zn—0.2Sn—0.1Mg | Contirod | 25 | 2-way | 8 | 760 | 92 |
| 10 | Cu—2.5Ni—0.6Si | Contirod | 50 | 2-way | 10 | 840 | 98 |
| 11 | Cu—2.5Ni—0.7Si—0.15Ag | Contirod | 50 | 2-way | 10 | 720 | 90 |
| 12 | Cu—3.8Ni—1.0Si—0.1Sn—1.2Zn | Contirod | 40 | 2-way | 8 | 780 | 96 |
| 13 | Cu—4.7Ni—1.2Si—0.1Mg—0.2Mn | Contirod | 50 | 2-way | 10 | 720 | 89 |
| 14 | Cu—2.3Ni—0.6Si—0.15Fe—0.15P | SCR | 5 | 2-way | 8 | 640 | 84 |
| 15 | Cu—2.7Ni—0.7Si—0.2Fe—0.8Zn | Contirod | 20 | 2-way | 8 | 730 | 89 |
| 16 | Cu—2.5Ni—0.6Si—0.2Cr—0.08Mg | SCR | 5 | 2-way | 8 | 830 | 95 |
| 17 | Cu—2.5Ni—0.6Si (2) | SCR | 5 | 2-way | 6 | 480 | 57 |
| 18 | Cu—3.7Ni—0.9Si—0.1Mg—0.2Mn (4) | SCR | 15 | 2-way | 8 | 520 | 65 |
| 19 | Cu—2.7Ni—0.6Si—0.3Sn—1Zn (6) | Properzi | 10 | 3-way | 8 | 500 | 63 |
| 20 | Cu—4.8Ni—1.3Si—0.12Ag (7) | SCR | 5 | 2-way | 8 | 500 | 61 |
| 21 | Cu—2.3Ni—0.6Si—0.15Fe—0.15P (14) | SCR | 5 | 2-way | 8 | 550 | 66 |
| 22 | Cu—2.7Ni—0.7Si—0.2Fe—0.8Zn (15) | Contirod | 20 | 2-way | 8 | 530 | 64 |
| 23 | Cu—2.5Ni—0.6Si—0.2Cr—0.08Mg (16) | SCR | 5 | 2-way | 8 | 500 | 59 |

As can be seen from the results in Table 1, each of Comparative examples Nos. 17 to 23 had a low solution-treated rate less than 70%. This means that those wire rods of the comparative examples are low in mechanical strength and thus a solution treatment must be performed separately.

Contrary to the above, the wire rods of Nos. 1 to 16 obtained by the method of the present invention had a high solution-treated rate of 80% or more, even without solution treatment. Thus, according to the present invention, the producing process can be shortened, and the Corson-based alloy wire rod can be produced at low cost in a shorter production time period.

Example 2

Hereinbelow, other examples are described in the same way as Example 1. Copper alloy wire rods having listed wire diameters were produced, by using copper alloys having an alloy composition as shown in Table 2 and using a variety of continuous casting and rolling apparatuses as shown in Table 2. The copper alloy wire rods produced by the method of the present invention are shown in Nos. 24 to 35. Further, the wire rods having the same compositions as those of Nos. 24, 29, and 30 but obtained at different quenching temperature, are shown in Nos. 36 to 38, respectively, as comparative examples.

Herein, the solution-treated rate, casting machine, rolling mill are listed in Table 2 in the same manner as in Example 1.

TABLE 2

| No. | Alloy composition | Castor | Casting rate (ton/hr) | Rolling mill | Diameter of wire rod (mm) | Quenching temperature (° C.) | Solution-treated rate (%) |
|---|---|---|---|---|---|---|---|
| 24 | Cu—0.8Ni—0.4Co—0.3Si | SCR | 5 | 2-way | 6 | 620 | 85 |
| 25 | Cu—1.8Ni—0.5Co—0.6Si | SCR | 5 | 2-way | 6 | 640 | 87 |
| 26 | Cu—3.4Ni—1.4Co—1.3Si | Contirod | 20 | 2-way | 8 | 790 | 94 |
| 27 | Cu—1.5Co—0.4Si | SCR | 5 | 2-way | 6 | 720 | 87 |
| 28 | Cu—3.8Co—1.0Si | SCR | 5 | 2-way | 6 | 750 | 90 |
| 29 | Cu—0.6Ni—0.5Co—0.3Si—0.12Mg—0.3Mn | SCR | 5 | 2-way | 6 | 760 | 92 |
| 30 | Cu—2.1Ni—1.1Co—0.8Si—0.15Sn—0.8Zn | SCR | 5 | 2-way | 6 | 730 | 88 |
| 31 | Cu—2.8Ni—0.4Co—0.8Si—0.5Zn—0.2Sn—0.1Mg | SCR | 5 | 2-way | 6 | 810 | 93 |
| 32 | Cu—3.7Ni—1.2Co—1.3Si—0.15Ag | SCR | 5 | 2-way | 6 | 750 | 88 |
| 33 | Cu—1.5Ni—2.2Co—0.9Si—0.7Fe—0.2P | SCR | 5 | 2-way | 6 | 630 | 86 |
| 34 | Cu—2.5Ni—0.3Co—0.6Si—0.2Fe—0.8Zn | SCR | 5 | 2-way | 6 | 650 | 88 |
| 35 | Cu—2.5Ni—2.1Co—1.2Si—0.25Cr—0.08Mg | SCR | 5 | 2-way | 6 | 730 | 92 |
| 36 | Cu—0.8Ni—0.4Co—0.3Si (24) | SCR | 5 | 2-way | 6 | 540 | 65 |
| 37 | Cu—0.6Ni—0.5Co—0.3Si—0.12Mg—0.3Mn (29) | SCR | 5 | 2-way | 6 | 480 | 53 |
| 38 | Cu—2.1Ni—1.1Co—0.8Si—0.15Sn—0.8Zn (30) | SCR | 5 | 2-way | 6 | 520 | 58 |

As can be seen from the results in Table 2, each of Comparative examples Nos. 36 to 38 had a low solution-treated rate less than 70%. This means that those wire rods of the comparative examples are low in mechanical strength as they are, and thus a solution treatment must be performed separately.

Contrary to the above, the wire rods of Nos. 24 to 35 obtained by the method of the present invention had a high solution-treated rate of 80% or more, even without solution treatment. Thus, according to the present invention, the producing process can be shortened, and the Cu(—Ni)—Co—

Si-based alloy wire rod can be produced at low cost in a shorter production time period.

Example 3

In the same manner as in Example 1, copper alloy wire rods having listed wire diameters were produced, by using copper alloys having an alloy composition as shown in Table 3 and using the continuous casting and rolling apparatus as shown in Table 3. The copper alloy wire rods produced by the method of the present invention are shown in Nos. 39 to 48. Further, the wire rods having the same compositions as those of Nos. 39, 42, and 43 but obtained at different quenching temperature, are shown in Nos. 49 to 51, respectively, as comparative examples.

Herein, the solution-treated rate, casting machine, rolling mill are listed in the table in the same manner as in Example 1.

TABLE 3

| No. | Alloy composition | Castor | Casting rate (ton/hr) | Rolling mill | Diameter of wire rod (mm) | Quenching temperature (° C.) | Solution-treated rate (%) |
|---|---|---|---|---|---|---|---|
| 39 | Cu—0.6Ni—0.5Sn | SCR | 5 | 2-way | 6 | 740 | 91 |
| 40 | Cu—1.4Ni—0.7Sn | SCR | 5 | 2-way | 6 | 760 | 92 |
| 41 | Cu—4.5Ni—2.3Sn | SCR | 5 | 2-way | 6 | 650 | 88 |
| 42 | Cu—8.3Ni—2.2Sn—0.12Mg—0.24Mn | SCR | 5 | 2-way | 6 | 620 | 87 |
| 43 | Cu—9.1Ni—3.4Sn—1.0Zn | SCR | 5 | 2-way | 6 | 720 | 90 |
| 44 | Cu—9.1Ni—2.3Sn—0.5Zn—0.1Mg | SCR | 5 | 2-way | 6 | 740 | 92 |
| 45 | Cu—9.3Ni—2.4Sn—0.15Ag | SCR | 5 | 2-way | 6 | 660 | 88 |
| 46 | Cu—12.5Ni—3.2Sn—0.6Fe—0.3P | SCR | 5 | 2-way | 6 | 630 | 87 |
| 47 | Cu—12.5Ni—3.4Sn—0.3Fe—0.7Zn | SCR | 5 | 2-way | 6 | 710 | 90 |
| 48 | Cu—14Ni—3.8Sn—0.3Cr—0.2Mg | SCR | 5 | 2-way | 6 | 660 | 86 |
| 49 | Cu—0.6Ni—0.5Sn (39) | SCR | 5 | 2-way | 6 | 470 | 46 |
| 50 | Cu—8.3Ni—2.2Sn—0.12Mg—0.24Mn (42) | SCR | 5 | 2-way | 6 | 560 | 63 |
| 51 | Cu—9.1Ni—3.4Sn—1.0Zn (43) | SCR | 5 | 2-way | 6 | 520 | 54 |

As can be seen from the results in Table 3, each of Comparative examples Nos. 49 to 51 had a low solution-treated rate less than 70%. This means that those wire rods of the comparative examples are low in mechanical strength as they are, and thus a solution treatment must be performed separately.

Contrary to the above, the wire rods of Nos. 39 to 48 obtained by the method of the present invention had a high solution-treated rate of 80% or more, even without solution treatment. Thus, according to the present invention, the producing process can be shortened, and the Cu—Ni—Sn-based alloy wire rod can be produced at low cost in a shorter production time period.

Example 4

In the same manner as in Example 1, copper alloy wire rods having listed wire diameters were produced, by using copper alloys having an alloy composition as shown in Table 4 and using the continuous casting and rolling apparatus as shown in Table 4. The copper alloy wire rods produced by the method of the present invention are shown in Nos. 52 to 62. Further, the wire rods having the same compositions as those of Nos. 52, 55, and 56 but obtained at different quenching temperature, are shown in Nos. 63 to 65, respectively, as comparative examples.

Herein, the solution-treated rate, casting machine, rolling mill are listed in the table in the same manner as in Example 1.

TABLE 4

| No. | Alloy composition | Castor | Casting rate (ton/hr) | Rolling mill | Diameter of wire rod (mm) | Quenching temperature (° C.) | Solution-treated rate (%) |
|---|---|---|---|---|---|---|---|
| 52 | Cu—0.6Ni—0.15Ti | SCR | 5 | 2-way | 6 | 730 | 94 |
| 53 | Cu—3.5Ni—0.75Ti | SCR | 5 | 2-way | 6 | 680 | 87 |
| 54 | Cu—4.5Ni—0.85Ti | SCR | 5 | 2-way | 6 | 660 | 87 |
| 55 | Cu—2.6Ni—0.26Ti—0.14Mg—0.35Mn | SCR | 5 | 2-way | 6 | 720 | 94 |
| 56 | Cu—2.7Ni—0.4Ti—0.3Sn—0.7Zn | SCR | 5 | 2-way | 6 | 670 | 87 |
| 57 | Cu—3.5Ni—0.23Ti—0.88Sn | SCR | 5 | 2-way | 6 | 670 | 88 |
| 58 | Cu—4.2Ni—0.7Ti—0.8Zn—0.1Mg | SCR | 5 | 2-way | 6 | 700 | 90 |
| 59 | Cu—4.8Ni—0.9Ti—0.15Ag | SCR | 5 | 2-way | 6 | 730 | 94 |
| 60 | Cu—2.5Ni—0.4Ti—0.13Fe—0.2P | SCR | 5 | 2-way | 6 | 710 | 92 |
| 61 | Cu—2.5Ni—0.5Ti—0.14Fe—0.8Zn | SCR | 5 | 2-way | 6 | 780 | 98 |
| 62 | Cu—2.7Ni—0.6Ti—0.15Cr—0.12Mg | SCR | 5 | 2-way | 6 | 680 | 90 |
| 63 | Cu—0.6Ni—0.15Ti (52) | SCR | 5 | 2-way | 6 | 540 | 56 |
| 64 | Cu—2.6Ni—0.26Ti—0.14Mg—0.35Mn (55) | SCR | 5 | 2-way | 6 | 580 | 63 |
| 65 | Cu—2.7Ni—0.4Ti—0.3Sn—0.7Zn (56) | SCR | 5 | 2-way | 6 | 500 | 54 |

As can be seen from the results in Table 4, each of Comparative examples Nos. 63 to 65 had a low solution-treated rate less than 70%. This means that those wire rods of the comparative examples are low in mechanical strength as they are, and thus a solution treatment must be performed separately.

Contrary to the above, the wire rods of Nos. 52 to 62 obtained by the method of the present invention had a high solution-treated rate of 80% or more, even without solution treatment. Thus, according to the present invention, the producing process can be shortened, and the Cu—Ni—Ti-based alloy wire rod can be produced at low cost in a shorter production time period.

Example 5

In the same manner as in Example 1, copper alloy wire rods having listed wire diameters were produced, by using copper alloys having an alloy composition as shown in Table 5 and using the continuous casting and rolling apparatus as shown in Table 5. The copper alloy wire rods produced by the method of the present invention are shown in Nos. 66 to 75. Further, the wire rods having the same compositions as those of Nos. 66, 68, and 69 but obtained at different quenching temperature, are shown in Nos. 76 to 78, respectively, as comparative examples.

Herein, the solution-treated rate, casting machine, rolling mill are listed in the table in the same manner as in Example 1.

TABLE 5

| No. | Alloy composition | Castor | Casting rate (ton/hr) | Rolling mill | Diameter of wire rod (mm) | Quenching temperature (° C.) | Solution-treated rate (%) |
|---|---|---|---|---|---|---|---|
| 66 | Cu—0.52Cr | SCR | 5 | 2-way | 6 | 670 | 86 |
| 67 | Cu—1.8Cr | SCR | 5 | 2-way | 6 | 620 | 83 |
| 68 | Cu—0.95Cr—0.12Mg—0.3Mn | SCR | 5 | 2-way | 6 | 720 | 93 |
| 69 | Cu—0.98Cr—0.35Sn—0.6Zn | SCR | 5 | 2-way | 6 | 670 | 88 |
| 70 | Cu—0.65Cr—0.48Sn | SCR | 5 | 2-way | 6 | 650 | 86 |
| 71 | Cu—0.76Cr—0.8Zn—0.1Mg | SCR | 5 | 2-way | 6 | 690 | 92 |
| 72 | Cu—1.3Cr—0.25Ag | SCR | 5 | 2-way | 6 | 670 | 88 |
| 73 | Cu—1.68Cr—0.25Fe—0.2P | SCR | 5 | 2-way | 6 | 730 | 94 |
| 74 | Cu—1.2Cr—0.3Fe—0.7Zn | SCR | 5 | 2-way | 6 | 650 | 87 |
| 75 | Cu—1.3Cr—0.24Mg | SCR | 5 | 2-way | 6 | 710 | 90 |
| 76 | Cu—0.52Cr (66) | SCR | 5 | 2-way | 6 | 530 | 53 |
| 77 | Cu—0.95Cr—0.12Mg—0.3Mn (68) | SCR | 5 | 2-way | 6 | 560 | 58 |
| 78 | Cu—0.98Cr—0.35Sn—0.6Zn (69) | SCR | 5 | 2-way | 6 | 430 | 48 |

As can be seen from the results in Table 5, each of Comparative examples Nos. 76 to 78 had a low solution-treated rate less than 70%. This means that those wire rods of the comparative examples are low in mechanical strength as they are, and thus a solution treatment must be performed separately.

Contrary to the above, the wire rods of Nos. 66 to 75 obtained by the method of the present invention had a high solution-treated rate of 80% or more, even without solution treatment. Thus, according to the present invention, the producing process can be shortened, and the Cu—Cr-based alloy wire rod can be produced at low cost in a shorter production time period.

Example 6

In the same manner as in Example 1, copper alloy wire rods having listed wire diameters were produced, by using copper alloys having an alloy composition as shown in Table 6 and using the continuous casting and rolling apparatus as shown in Table 6. The copper alloy wire rods produced by the method of the present invention are shown in Nos. 79 to 88. Further, the wire rods having the same compositions as those of Nos. 79, 81, and 82 but obtained at different quenching temperature, are shown in Nos. 89 to 91, respectively, as comparative examples.

Herein, the solution-treated rate, casting machine, rolling mill are listed in the table in the same manner as in Example 1.

TABLE 6

| No. | Alloy composition | Castor | Casting rate (ton/hr) | Rolling mill | Diameter of wire rod (mm) | Quenching temperature (° C.) | Solution-treated rate (%) |
|---|---|---|---|---|---|---|---|
| 79 | Cu—0.52Cr—0.2Zr | SCR | 5 | 2-way | 6 | 630 | 87 |
| 80 | Cu—0.68Cr—0.04Zr | SCR | 5 | 2-way | 6 | 760 | 94 |
| 81 | Cu—0.88Cr—0.18Zr—0.2Mg—0.15Mn | SCR | 5 | 2-way | 6 | 720 | 90 |
| 82 | Cu—0.84Cr—0.49Zr—0.2Sn—0.7Zn | SCR | 5 | 2-way | 6 | 780 | 94 |
| 83 | Cu—0.14Cr—0.67Zr—0.25Sn | SCR | 5 | 2-way | 6 | 680 | 87 |
| 84 | Cu—1.87Cr—0.21Zr—0.6Zn—0.15Mg | SCR | 5 | 2-way | 6 | 700 | 89 |
| 85 | Cu—1.3Cr—0.96Zr—0.15Ag | SCR | 5 | 2-way | 6 | 620 | 82 |
| 86 | Cu—1.2Cr—0.34Zr—0.25Fe—0.2P | SCR | 5 | 2-way | 6 | 610 | 81 |
| 87 | Cu—1.76Cr—0.13Zr—0.44Fe—0.51Zn | SCR | 5 | 2-way | 6 | 720 | 94 |
| 88 | Cu—0.98Cr—0.76Zr—0.28Mg | SCR | 5 | 2-way | 6 | 680 | 87 |
| 89 | Cu—0.52Cr—0.2Zr (79) | SCR | 5 | 2-way | 6 | 550 | 58 |
| 90 | Cu—0.88Cr—0.18Zr—0.2Mg—0.15Mn (81) | SCR | 5 | 2-way | 6 | 470 | 53 |
| 91 | Cu—0.84Cr—0.49Zr—0.2Sn—0.7Zn (82) | SCR | 5 | 2-way | 6 | 570 | 65 |

As can be seen from the results in Table 6, each of Comparative examples Nos. 89 to 91 had a low solution-treated rate less than 70%. This means that those wire rods of the comparative examples are low in mechanical strength as they are, and thus a solution treatment must be performed separately.

Contrary to the above, the wire rods of Nos. 79 to 88 obtained by the method of the present invention had a high solution-treated rate of 80% or more, even without solution treatment. Thus, according to the present invention, the producing process can be shortened, and the Cu—Cr—Zr-based alloy wire rod can be produced at low cost in a shorter production time period.

Example 7

In the same manner as in Example 1, copper alloy wire rods having listed wire diameters were produced, by using copper alloys having an alloy composition as shown in Table 7 and using the continuous casting and rolling apparatus as shown in Table 7. The copper alloy wire rods produced by the method of the present invention are shown in Nos. 92 to 99. Further, the wire rods having the same compositions as those of Nos. 92, 94, and 95 but obtained at different quenching temperature, are shown in Nos. 100 to 102, respectively, as comparative examples.

Herein, the solution-treated rate, casting machine, rolling mill are listed in the table in the same manner as in Example 1.

TABLE 7

| No. | Alloy composition | Castor | Casting rate (ton/hr) | Rolling mill | Diameter of wire rod (mm) | Quenching temperature (° C.) | Solution-treated rate (%) |
|---|---|---|---|---|---|---|---|
| 92 | Cu—0.52Fe—0.3P | SCR | 5 | 2-way | 6 | 760 | 94 |
| 93 | Cu—0.86Fe—0.74P | SCR | 5 | 2-way | 6 | 710 | 90 |
| 94 | Cu—1.86Fe—0.28P—0.18Mg—0.26Mn | SCR | 5 | 2-way | 6 | 750 | 94 |
| 95 | Cu—2.3Fe—0.42P—0.22Sn—0.7Zn | SCR | 5 | 2-way | 6 | 670 | 87 |
| 96 | Cu—2.6Fe—0.25P—0.4Sn | SCR | 5 | 2-way | 6 | 650 | 87 |
| 97 | Cu—2.8Fe—0.4P—0.5Zn—0.1Mg | SCR | 5 | 2-way | 6 | 750 | 94 |
| 98 | Cu—3.7Fe—0.65P—0.15Ag | SCR | 5 | 2-way | 6 | 690 | 87 |
| 99 | Cu—4.5Fe—0.89P—0.32Mg | SCR | 5 | 2-way | 6 | 680 | 88 |
| 100 | Cu—0.52Fe—0.3P (92) | SCR | 5 | 2-way | 6 | 530 | 58 |
| 101 | Cu—1.86Fe—0.28P—0.18Mg—0.26Mn (94) | SCR | 5 | 2-way | 6 | 550 | 63 |
| 102 | Cu—2.3Fe—0.42P—0.22Sn—0.7Zn (95) | SCR | 5 | 2-way | 6 | 480 | 46 |

As can be seen from the results in Table 7, each of Comparative examples Nos. 100 to 102 had a low solution-treated rate less than 70%. This means that those wire rods of the comparative examples are low in mechanical strength as they are, and thus a solution treatment must be performed separately.

Contrary to the above, the wire rods of Nos. 92 to 99 obtained by the method of the present invention had a high solution-treated rate of 80% or more, even without solution treatment. Thus, according to the present invention, the producing process can be shortened, and the Cu—Fe—P-based alloy wire rod can be produced at low cost in a shorter production time period.

Example 8

In the same manner as in Example 1, copper alloy wire rods having listed wire diameters were produced, by using copper alloys having an alloy composition as shown in Table 8 and using the continuous casting and rolling apparatus as shown in Table 8. The copper alloy wire rods produced by the method of the present invention are shown in Nos. 103 to 111. Further, the wire rods having the same compositions as those of Nos. 103, 105, and 106 but obtained at different quenching temperature, are shown in Nos. 112 to 114, respectively, as comparative examples.

Herein, the solution-treated rate, casting machine, rolling mill are listed in the table in the same manner as in Example 1.

TABLE 8

| No. | Alloy composition | Castor | Casting rate (ton/hr) | Rolling mill | Diameter of wire rod (mm) | Quenching temperature (° C.) | Solution-treated rate (%) |
|---|---|---|---|---|---|---|---|
| 103 | Cu—0.57Fe—2.3Zn | SCR | 5 | 2-way | 6 | 680 | 87 |
| 104 | Cu—0.97Fe—5.3Zn | SCR | 5 | 2-way | 6 | 670 | 88 |
| 105 | Cu—2.6Fe—2.6Zn—0.2Mg—0.4Mn | SCR | 5 | 2-way | 6 | 710 | 90 |
| 106 | Cu—2.6Fe—6.7Zn—0.28Sn | SCR | 5 | 2-way | 6 | 740 | 94 |
| 107 | Cu—1.68Fe—4.6Zn—0.26Cr | SCR | 5 | 2-way | 6 | 650 | 87 |
| 108 | Cu—2.4Fe—2.8Zn—0.1Mg | SCR | 5 | 2-way | 6 | 660 | 88 |
| 109 | Cu—2.3Fe—4.6Zn—0.15Ag | SCR | 5 | 2-way | 6 | 690 | 90 |
| 110 | Cu—3.7Fe—5.8Zn—0.16Mg | SCR | 5 | 2-way | 6 | 730 | 94 |
| 111 | Cu—4.6Fe—8.8Zn—0.35P | SCR | 5 | 2-way | 6 | 710 | 92 |
| 112 | Cu—0.57Fe—2.3Zn (103) | SCR | 5 | 2-way | 6 | 530 | 52 |
| 113 | Cu—2.6Fe—2.6Zn—0.2Mg—0.4Mn (105) | SCR | 5 | 2-way | 6 | 560 | 63 |
| 114 | Cu—2.6Fe—6.7Zn—0.28Sn (106) | SCR | 5 | 2-way | 6 | 510 | 48 |

As can be seen from the results in Table 8, each of Comparative examples Nos. 112 to 114 had a low solution-treated rate less than 70%. This means that those wire rods of the comparative examples are low in mechanical strength as they are, and thus a solution treatment must be performed separately.

Contrary to the above, the wire rods of Nos. 103 to 111 obtained by the method of the present invention had a high solution-treated rate of 80% or more, even without solution treatment. Thus, according to the present invention, the producing process can be shortened, and the Cu—Fe—Zn-based alloy wire rod can be produced at low cost in a shorter production time period.

Conventional Example

In the same manner as in Example 1, copper alloy wire rods having listed wire diameters, as Conventional examples, were produced, by using copper alloys having an alloy composition as shown in Table 9 (Nos. corresponding to the same compositions as the Nos. of Example 1 are shown in ( )) and using the continuous casting and rolling apparatus as shown in Table 9. Herein, the process of producing the copper alloy wire rod of the conventional example differs from the process of producing the copper alloy wire rod of the examples according to the present invention and the comparative examples in the following two points: (1) that no quenching was performed for the intermediate material of the copper alloy wire rod; and (2) that each temperature of the intermediate material of the copper alloy wire rod immediately after the rolling step was within a range of 250 to 400° C.

Herein, the solution-treated rate, casting machine, rolling mill are listed in the table in the same manner as in Example 1.

TABLE 9

| No. | Alloy composition | Castor | Casting rate (ton/hr) | Rolling mill | Diameter of wire rod (mm) | Quenching temperature (° C.) | Solution-treated rate (%) |
|---|---|---|---|---|---|---|---|
| 115 | Cu—2.5Ni—0.6Si (2) | SCR | 5 | 2-way | 6 | ***** | 26 |
| 116 | Cu—3.7Ni—0.9Si—0.1Mg—0.2Mn (4) | SCR | 5 | 2-way | 6 | ***** | 28 |
| 117 | Cu—1.5Co—0.4Si (27) | SCR | 5 | 2-way | 6 | ***** | 31 |
| 118 | Cu—2.1Ni—1.1Co—0.8Si—0.15Sn—0.8Zn (30) | SCR | 5 | 2-way | 6 | ***** | 21 |
| 119 | Cu—9.1Ni—2.3Sn—0.5Zn—0.1Mg (44) | SCR | 5 | 2-way | 6 | ***** | 24 |
| 120 | Cu—9.3Ni—2.4Sn—0.15Ag (45) | SCR | 5 | 2-way | 6 | ***** | 19 |
| 121 | Cu—3.5Ni—0.23Ti—0.88Sn (57) | SCR | 5 | 2-way | 6 | ***** | 23 |
| 122 | Cu—4.2Ni—0.7Ti—0.8Zn—0.1Mg (58) | SCR | 5 | 2-way | 6 | ***** | 26 |
| 123 | Cu—0.98Cr—0.35Sn—0.6Zn (69) | SCR | 5 | 2-way | 6 | ***** | 22 |
| 124 | Cu—0.65Cr—0.48Sn (70) | SCR | 5 | 2-way | 6 | ***** | 19 |
| 125 | Cu—1.87Cr—0.21Zr—0.6Zn—0.15Mg (84) | SCR | 5 | 2-way | 6 | ***** | 25 |
| 126 | Cu—1.3Cr—0.96Zr—0.15Ag (85) | SCR | 5 | 2-way | 6 | ***** | 21 |
| 127 | Cu—2.3Fe—0.42P—0.22Sn—0.7Zn (95) | SCR | 5 | 2-way | 6 | ***** | 24 |
| 128 | Cu—2.6Fe—0.25P—0.4Sn (96) | SCR | 5 | 2-way | 6 | ***** | 17 |
| 129 | Cu—2.3Fe—4.6Zn—0.15Ag (109) | SCR | 5 | 2-way | 6 | ***** | 25 |
| 130 | Cu—3.7Fe—5.8Zn—0.16Mg (110) | SCR | 5 | 2-way | 6 | ***** | 24 |

As can be seen from the results in Table 9, each of Conventional examples Nos. 115 to 130 had a quite low solution-treated rate of 17% to 31%. This means that those wire rods of the conventional examples are low in mechanical strength as they are, and thus a solution treatment must be performed separately.

INDUSTRIAL APPLICABILITY

The copper alloy wire rods of the present invention can be preferably used as wire harnesses for vehicles or other signal wires. Further, the copper alloy wire rod producing method of the present invention is preferable as a method for producing the copper alloy wire rods.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2006-154078 filed in Japan on Jun. 1, 2006, Patent Application No. 2007-082886 filed in Japan on Mar. 27, 2007, and Patent Application No. 2007-146226 filed in Japan on May 31, 2007, each of which is entirely herein incorporated by reference.

The invention claimed is:

1. A method of producing a copper alloy wire rod, the method comprising a continuous casting and rolling step, in which a casting step for obtaining an ingot by pouring molten copper of a precipitation strengthening copper alloy into a belt-&-wheel or twin-belt movable mold, and a rolling step for rolling the ingot obtained by the casting step, are continuously performed, wherein an intermediate material of the copper alloy wire rod in the mid course of the rolling step or immediately after the rolling step is quenched at a temperature of 600° C. or higher;

wherein the casting is conducted with controlling a ratio R represented by the following formula (1) to be 0.34 to 0.51, and optionally conducting a heating when R is greater than 0.51;

$$R=(\Delta T\times V+A)\div\{W\times(H+T+C)\} \quad (1)$$

wherein, ΔT is the cooling water temperature difference, V is a cooling water flow rate ($m^3$/hr), W is a casting rate (kg/hr), H is a latent heat (kcal/kg), T is a casting temperature (° C.), C is a specific heat (kcal/kg·° C.), and A is an amount of evaporation heat (kcal/hr); and wherein the casting step and the rolling step are completed within 300 seconds after pouring the molten copper of the copper alloy into the movable mold.

2. The method of producing a copper alloy wire rod according to claim 1, wherein the copper alloy contains 1.0 to 5.0% by mass of Ni, 0.25 to 1.5% by mass of Si, with the balance being composed of Cu and inevitable impurity elements.

3. The method of producing a copper alloy wire rod according to claim 1, wherein the copper alloy contains 1.0 to 5.0% by mass of Ni, 0.25 to 1.5% by mass of Si, 0.1 to 1.0% by mass of at least one element selected from the group consisting of Ag, Mg, Mn, Zn, Sn, P, Fe, and Cr, with the balance being composed of Cu and inevitable impurity elements.

4. The method of producing a copper alloy wire rod according to claim 1, wherein the copper alloy contains 1.0 to 5.0% by mass of Ni or Co in total, 0.25 to 1.5% by mass of Si, with the balance being composed of Cu and inevitable impurity elements.

5. The method of producing a copper alloy wire rod according to claim 1, wherein the copper alloy contains 1.0 to 5.0% by mass of Ni or Co in total, 0.25 to 1.5% by mass of Si, 0.1 to 1.0% by mass of at least one element selected from the group consisting of Ag, Mg, Mn, Zn, Sn, P, Fe, and Cr, with the balance being composed of Cu and inevitable impurity elements.

6. The method of producing a copper alloy wire rod according to claim 1, wherein the copper alloy contains 0.5 to 15.0% by mass of Ni, 0.5 to 4.0% by mass of Sn, with the balance being composed of Cu and inevitable impurity elements.

7. The method of producing a copper alloy wire rod according to claim 1, wherein the copper alloy contains 0.5 to 15.0% by mass of Ni, 0.5 to 4.0% by mass of Sn, 0.02 to 1.0% by mass of at least one element selected from the group consisting of Ag, Mg, Mn, Zn, P, Fe, and Cr, with the balance being composed of Cu and inevitable impurity elements.

8. The method of producing a copper alloy wire rod according to claim 1, wherein the copper alloy contains 0.5 to 5.0% by mass of Ni, 0.1 to 1.0% by mass of Ti, with the balance being composed of Cu and inevitable impurity elements.

9. The method of producing a copper alloy wire rod according to claim 1, wherein the copper alloy contains 0.5 to 5.0% by mass of Ni, 0.1 to 1.0% by mass of Ti, 0.02 to 1.0% by mass of at least one element selected from the group consisting of Ag, Mg, Mn, Zn, Sn, P, Fe, and Cr, with the balance being composed of Cu and inevitable impurity elements.

10. The method of producing a copper alloy wire rod according to claim 1, wherein the copper alloy contains 0.5 to 2.0% by mass of Cr, with the balance being composed of Cu and inevitable impurity elements.

11. The method of producing a copper alloy wire rod according to claim 1, wherein the copper alloy contains 0.5 to 2.0% by mass of Cr, 0.02 to 1.0% by mass of at least one element selected from the group consisting of Ag, Mg, Mn, Zn, Sn, P, and Fe, with the balance being composed of Cu and inevitable impurity elements.

12. The method of producing a copper alloy wire rod according to claim 1, wherein the copper alloy contains 0.5 to 2.0% by mass of Cr, 0.01 to 1.0% by mass of Zr, with the balance being composed of Cu and inevitable impurity elements.

13. The method of producing a copper alloy wire rod according to claim 1, wherein the copper alloy contains 0.5 to 2.0% by mass of Cr, 0.01 to 1.0% by mass of Zr, 0.02 to 1.0% by mass of at least one element selected from the group consisting of Ag, Mg, Mn, Zn, Sn, P, and Fe, with the balance being composed of Cu and inevitable impurity elements.

14. The method of producing a copper alloy wire rod according to claim 1, wherein the copper alloy contains 0.5 to 5.0% by mass of Fe, 0.01 to 1.0% by mass of P, with the balance being composed of Cu and inevitable impurity elements.

15. The method of producing a copper alloy wire rod according to claim 1, wherein the copper alloy contains 0.5 to 5.0% by mass of Fe, 0.01 to 1.0% by mass of P, 0.02 to 1.0% by mass of at least one element selected from the group consisting of Ag, Mg, Mn, Zn, Sn, and Cr, with the balance being composed of Cu and inevitable impurity elements.

16. The method of producing a copper alloy wire rod according to claim 1, wherein the copper alloy contains 0.5 to 5.0% by mass of Fe, 1.0 to 10.0% by mass of Zn, with the balance being composed of Cu and inevitable impurity elements.

17. The method of producing a copper alloy wire rod according to claim 1, wherein the copper alloy contains 0.5 to 5.0% by mass of Fe, 1.0 to 10.0% by mass of Zn, 0.02 to 1.0% by mass of at least one element selected from the group consisting of Ag, Mg, Mn, P, Sn, and Cr, with the balance being composed of Cu and inevitable impurity elements.

18. The method of producing a copper alloy wire rod according to claim 1, wherein the copper alloy contains a solution-treated rate of 80% or more;

wherein a solution-treated rate is calculated according to:

(Solution-treated rate)=(electric conductivity of the solution-treated state)÷(Electric conductivity of the copper alloy wire rod)×100.

19. The method of producing a copper alloy wire rod according to claim 1, wherein a raw material copper for the copper alloy is molten in a shaft furnace, reverberatory furnace, or induction furnace, and a deoxidation/dehydrogenation treatment is performed on the molten copper, and alloying element components are added, to form the molten copper of the copper alloy.

20. The method of producing a copper alloy wire rod according to claim 1, wherein the intermediate material of the copper alloy wire rod before the quenching is heated in the course of the rolling step.

* * * * *